United States Patent [19]

Thomas, Jr.

[11] 4,101,086

[45] Jul. 18, 1978

[54] YARN TIE-UP AND TRANSFER TAIL METHOD, AND YARN PACKAGE TUBE AND APPARATUS FOR THE METHOD

[75] Inventor: William A. Thomas, Jr., Bristol, Va.

[73] Assignee: Eastman Kodak Company, Rochester, N.Y.

[21] Appl. No.: 817,276

[22] Filed: Jul. 20, 1977

[51] Int. Cl.[2] ..... B65H 54/02; B65H 54/34; B65H 75/28

[52] U.S. Cl. ..... 242/18 PW; 242/125.1

[58] Field of Search ..... 242/18 PW, 18 A, 25 A, 242/125, 125.1; 57/34 TT

[56] References Cited

U.S. PATENT DOCUMENTS

| | | | |
|---|---|---|---|
| 3,097,804 | 7/1963 | Jackson | 242/18 PW |
| 3,149,795 | 9/1964 | Rhein, Jr. | 242/18 A |
| 3,276,704 | 10/1966 | Pabis | 242/18 PW |
| 3,284,023 | 11/1966 | Sowell | 242/125.1 |
| 3,326,494 | 6/1967 | Hartley, Jr. | 242/125.1 |
| 3,385,532 | 5/1968 | Sparling | 242/18 PW |
| 3,625,451 | 12/1971 | Anderson | 242/125.1 |
| 3,717,291 | 2/1973 | Adams et al. | 242/125.1 X |
| 3,964,721 | 6/1976 | Owens et al. | 242/18 PW |
| 3,971,518 | 7/1976 | Newman et al. | 242/18 PW |
| 4,046,329 | 9/1977 | Eisenberg et al. | 242/18 PW X |

FOREIGN PATENT DOCUMENTS

| | | | |
|---|---|---|---|
| 2,547,401 | 5/1976 | Fed. Rep. of Germany | 242/18 PW |
| 2,534,699 | 2/1977 | Fed. Rep. of Germany | 242/18 PW |

*Primary Examiner*—Stanley N. Gilreath

*Attorney, Agent, or Firm*—Malcolm G. Dunn; Daniel B. Reece, III

[57] ABSTRACT

Groove and corner having a side wall intersecting the groove in a textile yarn package tube results in the provision of an improved method for tying-up yarn to the yarn package tube and for forming a transfer tail, and in the further provision of apparatus for practicing the method.

31 Claims, 8 Drawing Figures

YARN TIE-UP AND TRANSFER TAIL METHOD, AND YARN PACKAGE TUBE AND APPARATUS FOR THE METHOD

BACKGROUND

This invention is directed to a yarn package tube for use with yarn winders on which textile and industrial yarns are wound into packages, the yarn package tube having means thereon by which a yarn moving at a high speed may be tied-up to a tube supported on a rotating yarn winder mandrel for subsequent transfer tail and yarn package formation; and to a method and to apparatus for practicing the method which cooperates with the means on the yarn package tube to accomplish the yarn tie-up and subsequent winding of the transfer tail and yarn package.

Other types of yarn package tubes on which transfer tails and yarn packages are wound are well-known in the art. Some representative patents disclosing such yarn package tubes are Adams et al, U.S. Pat. No. 3,717,291; Sowell, U.S. Pat. No. 3,284,023; Heatherly, U.S. Pat. No. 3,103,305; and Pabis, U.S. Pat. No. 3,276,704.

Other devices and apparatus for forming transfer tails on yarn package supports, particularly on yarn package supports that are rotating at the desired yarn package winding speeds, are also well known in the art. Some of these prior art devices or apparatus are represented in the Newman et al patent, U.S. Pat. No. 3,971,518; the Spaller patent, U.S. Pat. No. 3,999,716; the Pabis patent, U.S. Pat No. 3,276,704; the Rhein, Jr. patent, U.S. Pat. No. 3,149,795; The Nugent patent, U.S Pat. No. 3,224,692; the Ratti patent, U.S. Pat. No. 3,575,355, the Emery patent, U.S. Pat. No. 3,428,266; the Porter patent, U.S. Pat. No. 3,282,516; and the Bolger patent, U.S. Pat. No. 3,275,252.

The textile winders concerned with this invention usually involve a yarn package support, which may be surface-driven, and where the traversing action for even distribution of the yarn on the yarn package support may be obtained by use of a drive roll having a spiral groove in its surface to traverse the yarn as it is wound on the package, as in the case of the above-mentioned Nugent patent, U.S. Pat. No. 3,224,692. The traversing action may also be accomplished by the reciprocating motion of a yarn traverse guide through which the yarn advances to the yarn package support or tube, as in the case of the above-mentioned Newman et al patent, U.S. Pat. No. 3,971,518; Spaller patent, U.S. Pat. No. 3,999,716; and the Pabis patent, U.S. Pat. No. 3,276,704.

The "transfer tail" is an initial wrap or turn or series of wraps or turns in the form of a single layer of a short length of helices at one end of the yarn package support or tube just beyond the package portion of the tube. The purpose of the transfer tail is to facilitate the tying of the outer end of yarn from another yarn package to the transfer tail of the yarn package being processed or used in a textile mill so as to preserve the continuity of the operating process without the necessity of shutting equipment down when a yarn package becomes depleted. Hence, the transfer tail yarn quality must be comparable to the yarn in the yarn package.

The winder for which this invention, the transfer tail apparatus, is particularly adapted is the BARMAG SW4S series Winder, Barmer Machinefabrik A.G., which winds yarn onto packages at speeds in excess of 3000 meters per minute. In making tie-ups and transfer tails on yarn packages at these speeds any excessive slack in the winding system generated following the tie-up or connection of the yarn to the yarn package support or tube can cause a number of problems. "Tie-up", for purposes of this description, means connection of the yarn to the yarn package tube.

Initially, before tie-up of the yarn to the yarn package tube, the yarn is traveling toward the winder at speeds in excess of 3000 meters per minute. The yarn is being taken up by a waste aspirator or air doffer, which also serves to maintain the desired tension on the yarn. Any momentary excessive slack in tension following the moment of tie-up to the yarn package tube can cause a roll wrap around the godet roll that precedes the winder. The roll wrap would thus cause a breakdown of the system. If, for whatever reason, a roll wrap should fortuitously be avoided, despite the presence of undesirable slack, and a successful tie-up should be made to the yarn package tube, slack yarn will be present during winding the first few layers of yarn on the yarn package tube. This can cause separated or spread filaments next to the surface of the tube, and thus cause damaged filaments.

Another problem resulting from undesirable slack is that the yarn is not pulled sufficiently tight on the yarn traverse guide, and thus on the pick-up of the yarn by the yarn traverse guide the latter does not pick up all of the filaments at the same time, but instead picks up the remainder on the next reciprocation. This results in the filaments becoming undesirably separated, and can cause a breakdown of the yarn end during subsequent processing.

Still another problem resulting from excessive slack: Since the yarn layers next to the tube surface are not tensioned the same as the outer yarn layers, a potential dye take-up difference problem is created.

The separated filament problem also extends to the transfer tail when the yarn is either of low twist or is a non-TF (non-entangled filament) yarn. The filaments become separated in the transfer tail, with the possibility that the entire strand of yarn may not be tied-up to the next successive package during yarn processing. If the filaments are picked-up out of phase, some of the yarn strands will be drawn more than other strands when the yarn being wound is only partially oriented. When the yarn is later processed, such as by undergoing a draw texturing operation, the subsequent resulting different dye take-up in a dyeing process may cause flashes in fabric made from such yarn.

An object, therefore, of the present invention is to reduce slack in the yarn to a minimum at the time following tie-up or connection of the yarn to the yarn package support or tube.

Some of the transfer tail apparatus and devices in the prior art depend upon yarn tension for causing movement of the transfer tail device. Since yarn tension can vary, this will result in different movement or rotational rates in the transfer tail device which may thus cause the helices to be too closely spaced so as to make it difficult for the operator to find a yarn end and tie-up to the next yarn package. If the transfer tail is too widely spaced, the length of the tail may be too short to enable tie-up to the next yarn package.

For instance, the transfer tail device provided by Barmer Machinenfabrik A.G. on the BARMAG SW4S Winder comprises a light-weight arm that rotates as a result of the yarn releasing a latch and exerting a force on the arm by the tension of the yarn. The spacing between helices or turns in the transfer tail on the yarn package tube depends upon the rate of rotation of the arm which in turn depends upon the tension of the yarn, bearing friction, and inertia of the arm. The latch is connected to the arm, and adjustments made to account for changes in the path of the yarn in order to insure proper release of the latch alter the inertia of the arm. Small changes in the inertia and friction will occur and affect the rotation of the arm since the low yarn tension forces are the only forces for causing rotation of the light-weight arm.

An object of the invention, therefore, is to provide an improved textile yarn package tube, which may be made from multi-ply paper or other suitable material, having cooperating structure by which a yarn may be readily tied-up to the tube and a transfer tail formed in a high speed winding operation.

Another object of the invention is to provide a method for cooperation with the cooperating structure on yarn package tube by which a yarn may be reliably tied-up to the yarn package tube and a transfer tail formed in a controlled, repeatable manner.

Still another object of the invention is to provide an apparatus for practice of the method by which a yarn may be reliably tied-up to the yarn package and a transfer tail formed in a manner independent of variations in yarn tension, path of the yarn, and friction changes.

SUMMARY OF THE INVENTION

The invention thus concerns an improved textile yarn package tube, a method and an apparatus for practicing the method by which yarn is tied up to the yarn package tube and a transfer tail is formed on the outer end of a rotating yarn package tube mounted on a winder mandrel when the yarn is traveling at speeds in excess of 3000 meters per minute. The yarn package tube, the method and the apparatus, of course, are also capable of being used with winders operating at slower speeds. The yarn winder may have a self-threading yarn traverse guide, which is driven in reciprocation along a path that is parallelly spaced from the package portion of the yarn package tube and which guides the yarn onto the package portion of the tube.

(a) Yarn Package Tube

The improved textile yarn package tube, which is preferably made of multi-ply paper, although it may also be made from other suitable materials, has a substantially cylindrical body. The cylindrical body has formed in its external surface adjacent one end thereof a groove defined by a pair of side walls extending into the surface of the cylindrical body and extending at least partly around the body in a plane substantially perpendicular to the rotation axis of the tube. Grooves per se, as previously stated, are well-known in the art.

What appears to be new, however, is the provision of a structure located on the yarn package tube adjacent the groove for cooperation therewith and by which in rotary winding operations, as a yarn enters the groove in one direction of movement, a portion of the yarn exiting from the groove is snagged and deflected around the structure for changing the direction of movement of the existing yarn portion as the adjacent structure is rotated with the yarn package tube.

The structure on the yarn package tube is preferably located between the groove and the above-mentioned one end of the cylindrical body to which the groove is adjacent.

The "adjacent cooperating structure" could be a pin, which could extend from the surface of the yarn package tube adjacent the groove. The portion of yarn exiting from the groove could be deflected partly around the pin for movement in a different direction as the pin rotates with the tube away from where the yarn first enters the groove. A pin may not be commercially practical, however, because it might interfere with a yarn package surface drive roll. Also, there would be the additional expense involved in making and securing the pin in the yarn package tube.

The "adjacent" structure that cooperates with the groove is, therefore, more preferably defined by a corner, which is formed in the surface of the tube is one of the side walls of the groove. The corner points in the direction of intended rotation of the tube when the tube is supported for such rotation upon a winder mandrel and includes a side wall intersecting one side wall of the groove in an angle, preferably an acute angle. The actue angle may be within the range of about 25° to about 60°, and is preferably about 30° to about 45°, and is still more preferred to be about 35°. One of the limiting factors for the low end of the maximum range of angles appears to be dependent upon the nature of the material from which the yarn package tube is made. If the tube is made from multi-ply paper, the acute-angled corner may become too thin and thus become torn out during the tie-up operation. A limiting factor for the high end of the maximum range of angles appears to be dependent upon how well the yarn is retained and deflected by the acute-angled corner. Thus, the maximum range of angles that may be used is only approximate, with the preferred angles and still more preferred angle giving more assurance of carrying out their intended purpose.

In forming the corner, the acute-angled corner may be displaced from the groove wall, with which one of the corner side walls intersects, in a direction toward the opposite side wall of the groove, with the acute-angled corner extending in part over the groove.

Also, in forming the corner, the corner may be raised slightly above the surface of the cylindrical body of the yarn package tube.

Further, in forming the corner, the acute-angled corner may be both displaced in part over the groove and raised slightly above the surface of the cylindrical body of the yarn package tube.

In either situation of displacement of the acute-angled corner or slightly raising the acute-angled corner, or using a combination of both situations, more assurance is provided that the yarn existing from the groove will be picked-up or snagged and deflected by the acute-angled corner in the manner described.

The side walls of the groove in the yarn package tube define, respectively, an outboard wall adjacent the one end of the tube cylindrical body, and an inboard wall that is spaced axially inwardly along the tube cylindrical body from the inboard wall. The side wall of the corner preferably intersects the outboard wall of the groove, thus the corner is on the side of the groove axially outwardly along the tube cylindrical body from the groove.

The pair of side walls of the groove in the tube cylindrical body may preferably meet in an acute angle at the bottom of the groove so as to pinch the yarn to trap or to restrict yarn movement relative to the tube once the yarn has been tied-up to the tube and snapped and severed from the yarn moving away from the tube, as into a yarn or waste air doffer.

The corner is bounded on one side by a cross-cut notch that is defined by a pair of side walls that converge to an acute angle away from the groove side wall with which the side walls of the cross-cut notch intersect. The converging side walls of the cross-cut notch may pinch the yarn to trap or restrict yarn movement relative to the tube to assist in snagging, snapping and severing of the yarn. For this reason also, it may be preferable to make the yarn package tube from multiply paper so that in addition to the yarn being deflected around the acute-angled corner the yarn will also become pinched between the plies of the paper tube within the acute-angled corner.

(b) Method

In the method of the invention, as particularly practiced with the yarn package tube described above, and as being supported on a rotating yarn winder mandrel, the yarn is moving from a source of supply (not shown) to the yarn package tube for engagement with a portion of the surface thereof and for subsequent movement away from the tube, as into an air doffer. It should be especially noted that the portion of the tube surface with which the yarn engages is rotating in the same direction as the direction of yarn movement.

In the prior art, the yarn usually moves in a direction that is the reverse of tube rotation, such as occurs, for instance, in the above-mentioned Pabis patent, U.S. Pat. No. 3,276,704. Then, when the yarn is snagged by the groove in Pabis, slack will occur in the yarn until the tube has rotated about 180° and thus thereafter takes up the tension on the yarn. In the instant invention, since the yarn and the surface portion of the tube contacted by the yarn are moving in the same direction, any possible slack at moment of deflection and snagging is either eliminated or is significantly minimized to such extent that no roll wrap will occur on any preceding godet roll (not shown) that may exist along the yarn path prior to reaching the yarn winder.

In the method of this invention, therefore, the yarn is first positioned for engagement with the surface portion of the rotating supported yarn package tube in a partial arch at an initial location along the tube length that is away from and out of contact with the groove and the adjacent structure or adjacent cross-cut notch. The "partial arch" is in part a consequent of the yarn bearing in engagement against an arcuate surface portion of the cylindrical tube. The "partial arch" also insures that the yarn will be sufficiently urged toward the surface of the tube so that the yarn will drop readily into the groove when the yarn is moved sideways to the groove. The positioning of the yarn at an "initial location" along the tube length must be such that the yarn does not come into contact with the groove or drop into the groove before the operator is ready to make the tie-up of the yarn to the yarn package tube.

The yarn is then guided sideways along the surface of the rotating yarn package tube toward the groove and adjacent cooperating structure or cooperating corner until the yarn drops into the groove and the existing portion of the yarn engages the adjacent structure or acute-angled corner and becomes snagged and deflected therearound with its direction of movement being changed as the adjacent structure or acute-angled corner rotates with the tube away from where the yarn approaches the referred-to surface portion of the tube. The yarn, as a consequence of such snagging and deflection, thus becomes tied-up to the tube, and subsequently is snapped and severed from the yarn going away from the tube.

When the exiting yarn portion is "deflected", the consequent change of its direction of movement is only momentary. As the deflecting structure, such as a pin or the more preferred acute-angled corner, rotates with the tube, carrying with it a portion of the yarn, the tension suddenly exerted on the yarn between the deflecting structure and where the yarn is going into the air doffer increases to the extent that the yarn snaps and breaks or becomes severed.

After the tie-up of the yarn to the yarn package tube, the yarn is wound into a predetermined number of wraps on the tube, as the tube continues to rotate, to form a waste bunch; next the yarn is wound into a predetermined number of spaced apart helical wraps to form a transfer tail adjacent the waste bunch; and finally, the yarn is wound into a yarn package adjacent the transfer tail. The wrapping of waste bunches and transfer tails is well-known in the art. There are many different ways to accomplish this. Some of the same problems, however, have always been presented: How to reproduce good transfer tails on each and every yarn package; and how to assure that all of the filaments for a yarn end are in the transfer tail so that when a yarn processing operator pulls out a yarn end from the transfer tail, some of the filaments are not trapped in the yarn package or otherwise separated from the bundle that is supposed to comprise the yarn end.

The method, as practiced in cooperation with the particular yarn package tube described above, may be practiced with the aid of an air doffer as the operator uses the air doffer to thread-up the winder apparatus. A suitable yarn guide structure would be located along one side of the yarn package tube between the tube and the source of yarn supply. The operator would thread the yarn through such guide structure and then manually position the air doffer at a predetermined location along the other side of the tube in such manner that the yarn would bear in engagement in a partial arch with an arcuate surface portion of the yarn package tube. When the operator is ready to make the tie-up, he would move the air doffer in a sidewise motion and thus guide the yarn sideways toward the groove in the surface of the yarn package tube until the yarn drops into the groove and the exiting portion of the yarn from the groove becomes deflected, as heretofore described. The above-mentioned "suitable yarn guide structure" could be triggered to release the yarn in a conventional mechanical manner by means of an electric switch or mechanical release that the operator could contact with his air doffer as he continued its sidewise motion movement to a location past alignment with the tube groove. The yarn guide structure could merely be designed to release the yarn, and the normal tension on the yarn from the yarn supply source may be relied upon to cause the yarn to move to a position along the front of the yarn winder until the yarn is picked-up by the yarn traverse guide, forming in the meantime a transfer tail as the yarn moves toward pick-up location of the yarn traverse guide. It would be preferable, however, that the yarn guide structure also be designed to move along the length of the tube so as to control the formation of the transfer tail wraps and thus assure uniformity of transfer tail wraps from package to package. Such yarn guide structure movement can be accomplished in any number of different ways, and as is well-known in the art.

(c) Apparatus

Apparatus may also be used to practice the method so as to minimize the skills and care needed by an operator in carrying out the method with only the aid of an air doffer. The apparatus, in cooperation with the yarn package tube described above, may comprise an arrangement for positioning or automatically positioning the yarn in engagement with a surface portion of the yarn package tube in a partial arch at an initial location along the tube that is away from and out of contact with the groove and the adjacent structure or adjacent corner. The positioning arrangement may comprise a yarn guiding means that is located along one side of the mandrel supported yarn package tube that is between the tube and the source of supply (not shown), and another yarn guiding means that is located along the other side of the mandrel supported yarn package tube. One of the purposes of such positioning arrangement, as heretofore mentioned, is to assure that the yarn does not come into contact with the groove before the operator is ready to make the yarn tie-up to the yarn package tube.

When the operator is ready to make the yarn tie-up, he may initiate in some suitable mechanical manner the sideways movement of the yarn guide means relative to the tube length so that the yarn moving between the guide means and being guided thereby is in turn moved sideways along the yarn tube surface toward the groove and the aforementioned adjacent cooperating structure on the tube. When the yarn drops into the groove and its existing portion becomes snagged and deflected and subsequently snapped and severed, in the manner heretofore described, the waste bunch is formed in and on top of the groove until the first guide means is moved in the opposite direction along the length of the tube in some suitable mechanical manner to guide the yarn as the spaced helical wraps are formed for the transfer tail. At some predetermined point during the first yarn guide means movement, the yarn may be released from the first yarn guide means for pick-up by a yarn traverse guide means on the yarn winder for winding of the yarn package on the yarn package tube.

DESCRIPTION OF THE PREFERRED EMBODIMENT

Figure 1:
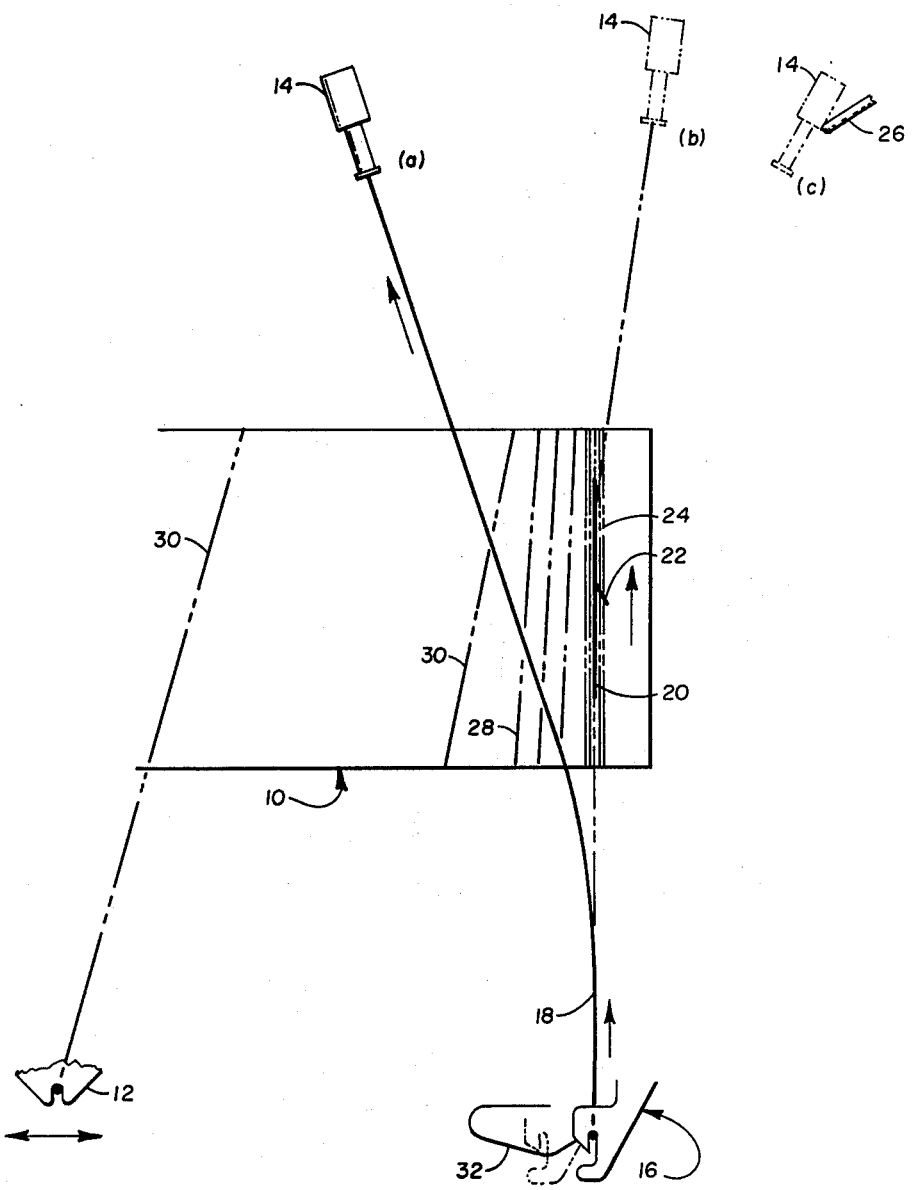
FIG. 1 is a plan view of a portion of the yarn package tube of this invention as the tube may be positioned in a yarn winder, with only a few components of a yarn winder illustrated to show their positional relation to the tube, and which illustrates in solid lines the relative initial operating positions and in phantom lines the relative subsequent operating positions of the yarn, of a yarn guide and of an air doffer in relation to the yarn package tube.

In reference to the drawings, particularly to FIG. 1 in which one embodiment of apparatus is illustrated for practicing the method of this invention, a yarn package tube 10 is shown in the position it usually occupies in a yarn winder. Only the self-threading yarn traverse guide 12 of the winder is illustrated, since winders per se and drives for causing the yarn traverse guide to move in reciprocation along a path parallelly spaced from the yarn package tube are well-known in the art. The yarn package tube shown is mounted on a winder mandrel (not shown in FIG. 1) for rotation with the mandrel. It is also well-known to lock a yarn package tube in some suitable manner to the winder mandrel so that the tube will rotate with the mandrel. A separate drive roll (also not shown) of the yarn winder usually engages the yarn package tube for driving it to the desired rotational winding speeds, as is the case with the BARMAG SW4S series winder, previously mentioned.

An air doffer, shown at 14, is manually controlled or manipulated by an operator, and is shown as being positioned on the opposite side of the yarn package tube from a yarn guide 16, which is located adjacent the path of the self-threading yarn traverse guide. Yarn 18 is shown as having been threaded through the yarn guide 16, and from the yarn guide the yarn extends across the yarn package tube 10 in engagement therewith and then away from the tube and winder and into the air doffer 14.

Figure 2:
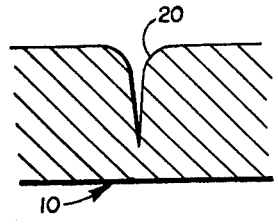
FIG. 2 is a cross-sectional view of a groove that may be formed in the yarn package tube.

As previously mentioned, the yarn package tube is preferably made of multi-ply paper and comprises a substantially cylindrical body. A circumferential groove 20 is formed in the external surface of the cylindrical body of the tube adjacent one end of the cylindrical body; the groove is defined by a pair of side walls, which extend into the surface of the cylindrical body and at least partly around the cylindrical body so as to lie in a plane substantially perpendicular to the rotation axis of the tube. The side walls of the groove may meet at the bottom of the groove in an acute angle, as shown in FIG. 2, so as to provide a sharp pinch point for the yarn to aid in trapping or snagging the yarn. The groove 20 may also extend completely around the package tube, but it is generally preferable that the groove only extend partly around, as shown, so as to make it easier to slide a waste bunch from the end of the tube when a transfer tail is to be connected to the leading yarn end of another yarn package.

Circumferential grooves adjacent to or spaced from one end of a yarn package tube are generally well-known in the art. The abovementioned Pabis U.S. Pat. No. 3,276,704 broadly discloses grooves in a two tube arrangement, while the Lowell U.S. Pat. No. 3,284,023 and Heatherly U.S. Pat. No. 3,103,305 describe and specifically illustrate in detail some possible configurations of such grooves. The Adams et al U.S. Pat. No. 3,717,291 is still another disclosure of a specifically illustrated circumferential groove.

One of the things uniquely different about the invention from the prior art, as mentioned previously, is the formation of a corner as by a cross-cut notch or slit 22, which is cut or formed in the surface of the yarn package tube in such manner as to intersect one of the side walls of the groove and from therewith angle, preferably an an acute angle, with the resulting corner facing toward the direction of intended rotation of the yarn package tube. The side walls of the cross-cut notch may converge to an acute angle (see FIGS. *3a, 3b, 3c*) so as to provide a sharp pinch point for the yarn, as mentioned above. As also previously stated, the cross-cut notch may be formed in such manner that the resulting acute-angled corner is displaced over the groove and toward the opposite side wall of the groove. The corner should not be displaced to such extent as to touch the opposite side wall of the groove because there should be no hindrance to the yarn entering the groove. Also, the corner may be raised slightly above or from the surface of the tube cylindrical body, as previously stated. The corner may further be both displaced over the groove and raised slightly above ths surface of the tube cylindrical body. In any of these situations, the purpose is to provide assurance that the yarn will be picked-up or snagged and deflected by the acute-angled corner in the manner disclosed.

In preparing for tie-up of the yarn 18 to the yarn package tube 10, the operator uses the air doffer 14 to thread the yarn through the yarn guide 16. He then positions the yarn across and in engagement with a surface portion of the yarn package tube in such manner that the tube surface portion that is engaged by the yarn will be rotating or moving in the same direction as the engaging yarn is moving. The yarn, at that time, is also positioned initially at a location along the tube length and out of contact with the groove 20 and corner as formed by cross-cut notch 22. The operator is thus holding the air doffer at a position along the yarn package tube on the opposite side from the yarn guide 16 so that the yarn bears in engagement with the yarn package tube in a partial arch.

After the operator assures himself that the yarn package tube is brought up to desired winding speed, he then moves the air doffer 14 in a sidewise direction so that the yarn 18 is guided sideways along the surface of the yarn package tube until the yarn drops into the groove 20 and a portion of the yarn exiting from the groove is running across one of the groove side wall shoulders. Note in FIG. 1, for instance, that at the phantom line position marked "(*b*)" of the air doffer, the yarn is entering the groove and is exiting across a shoulder of the groove. The "shoulders" of the groove may be seen in FIG. 2 and FIGS. *3a, 3b* and *3c*.

When the corner rotates into position, the yarn portion exiting from the groove is picked-up or snagged and deflected by the acute-angled corner (Note FIGS. *3a, 3b* and *3c*.). As the acute angled corner rotates with the yarn package tube away from where the yarn enters the groove, the direction of yarn movement of the portion of the yarn deflected by the acute-angled corner is changed. It is only a momentary change of direction because the tension suddenly exerted between the point where the yarn is being deflected and where the yarn is going into the air doffer increases to such extent as to cause a snapping and severance of the yarn from the yarn going to the air doffer. The yarn is thus connected to the yarn package tube by either the pinch point in the cross-cut notch or the pinch point in the groove or a combination of both pinch points. In using a multi-ply paper tube, the yarn may also be pinched in the multi-ply layers at the acute-angled corner.

The yarn 18 is now moving from a supply source (not shown) to and through the yarn guide 16 and onto the rotating yarn package tube 10. The yarn guide 16 is also now guiding the yarn as the yarn wraps around the tube to form a waste bunch in and on top of the groove 20, as shown in phantom lines at 24.

When the operator moves the air doffer to the phantom line position marked "(*c*)" in FIG. 1, a switch or lever 26 may be designed to be engaged by the air doffer to trigger in suitable manner the release of yarn guide 16.

Yarn guide 16 may either (1) be adapted to merely release the yarn for subsequent winding of the transfer tail (shown in phantom lines at 28), followed by pick-up by the self-threading yarn traverse guide 12 for winding of the package (shown at 30); or (2) be adapted to move along a path for controlling the movement of the yarn onto the yarn package tube so as to assure formation of uniform transfer tails from package to package. In the latter instance and as shown in FIG. 1, the yarn guide 16 may move relative to a fixed cam guide surface 32, which causes the yarn to move out of the slot in the yarn guide and along the sloped cam surface for subsequent pick-up of the yarn by the selfthreading yarn traverse guide 12. The movement of yarn guide 16 may be a pivoting or horizontal movement, and a spring or other suitable means may provide the motive power for such movement. The above-mentioned Parry U.S. Pat. No. 3,488,010 illustrates a yarn guide that operates in nearly similar manner.

In reference to FIGS. *3a, 3b* and *3c*, a yarn package tube 40 is shown as being mounted on a yarn winder mandrel 42. The groove 44 is shown as extending within the surface of the cylindrical body of the tube only partly around the tube. The cross-cut notch, which may be used to form the acute-angled corner, is shown at 46.

As illustrated in FIG. *3a*, the yarn 48 has just dropped into the groove 44 and exits from the groove to pass through a pigtail yarn guide 50, and then beyond the guide the yarn would go to an air doffer (not shown). It should be noted that the yarn and the surface portion of the tube contacted by the yarn are moving in the same direction, as shown by the arrows.

In FIG. *3b*, the acute-angled corner in its rotation with the tube is illustrated as approaching the portion of the yarn that is exiting from the groove 44. The pigtail yarn guide 50 has moved from the position, shown in FIG. *3a*, to a point along its path of movement that causes the exiting portion of the yarn 48 to bear against one of the shoulders of the groove 44.

Figure 3A:
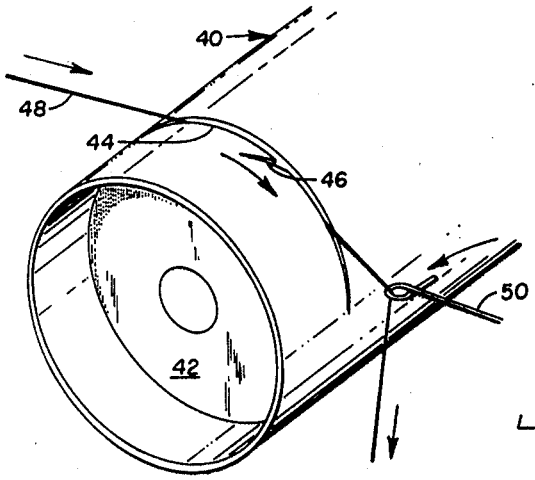
FIG. 3*a* is an isometric view of a portion of the yarn package tube and of a pigtail guide portion to illustrate the path of the yarn after it has dropped into the groove in the tube.
Figure 3B:
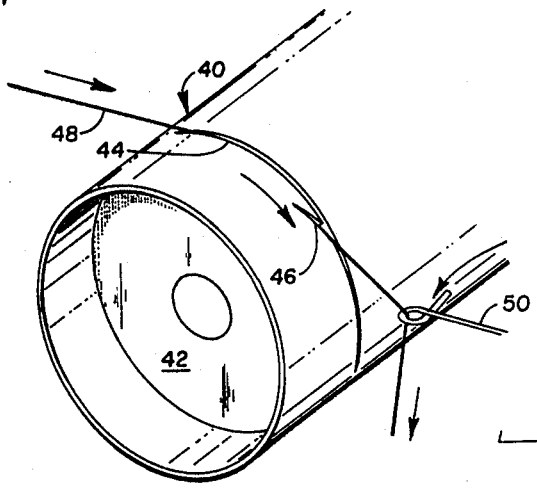
FIG. 3*b* is a view similar to FIG. 3*a* but illustrating how the yarn is about to be picked-up from the groove by the acute-angled corner as the pigtail portion continues its movement.

In FIG. *3c*, the acute-angled corner has snagged and deflected the exiting portion of the yarn and has caused the exiting yarn portion to change its direction as the acuate-angled corner has rotated to a position further around from the position shown in FIG. 3*b*. The yarn in the meantime is shown as entering deeper within the cross-cut notch.

It should be noted that although the yarn is illustrated as passing over and in engagement with the top of the tube, the yarn could also contact a bottom surface portion of the yarn package tube, so long as the surface portion contacted is moving in the same direction as the yarn. In some winders for instance, a drive roll contacts the yarn package tube from the top, and in some other winders, the drive roll contacts the yarn package tube from the bottom. The invention, therefore, should not be understood to be limited to engaging with the yarn the yarn tube at the top of the tube.

As also hereto mentioned, the acute angle of the resulting corner may range from about 25° to about 60°, and may preferably range from about 30° to about 45°, and may still more preferably be about 35°.

Figure 4C:
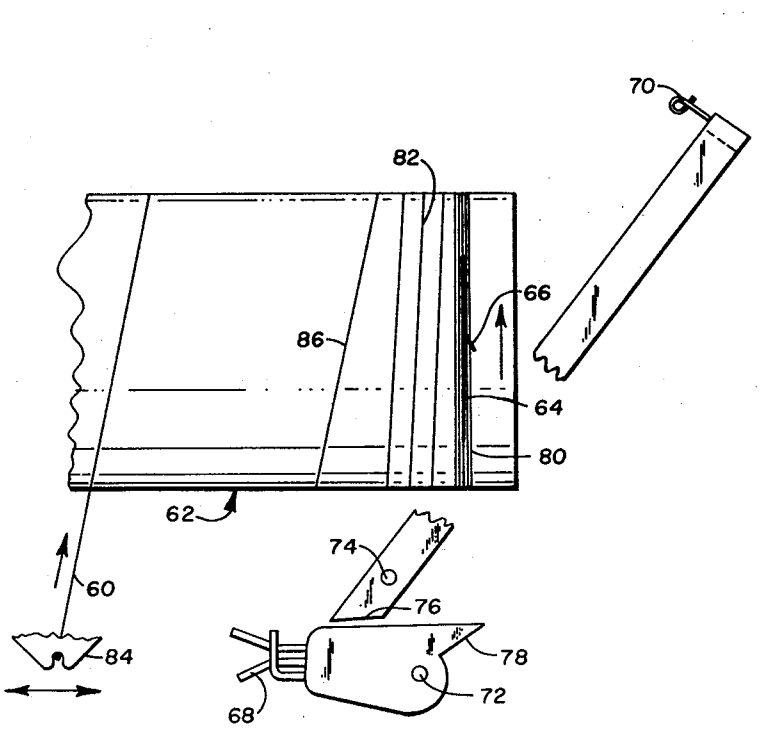
FIG. 4*c* is a plan view as shown in FIGS. 4*a* and 4*b* and illustrates the positions of the first and second yarn guides after the yarn has been released for forming the transfer tail and the package.
Figure 4B:
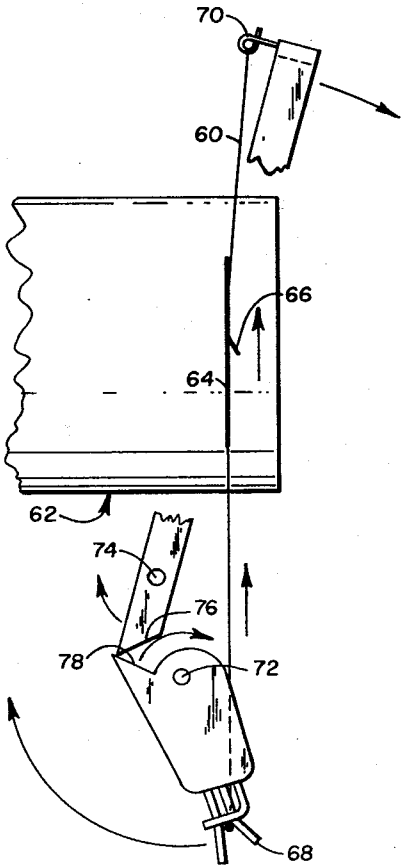
FIG. 4*b* is a plan view as shown in FIG. 4*a* but illustrates the position of the different elements when the yarn has been moved sidewise to drop into the groove in the tube and an exiting portion of the yarn from the groove has been bent over a shoulder of the groove.
Figure 4A:
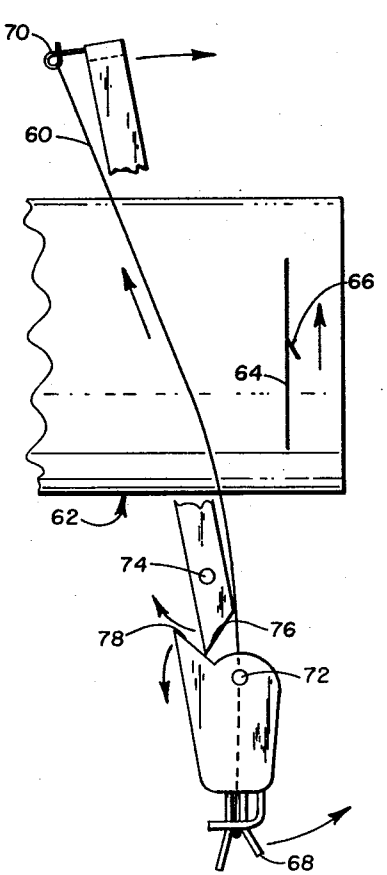
FIG. 4*a* is a plan view of an apparatus arrangement, which is different from that illustrated in FIG. 1, showing a portion of the yarn packing tube, the yarn as initially positioned in engagement with a surface portion of the tube, the first yarn guide positioned along one side of the tube and a second yarn guide, broken away in part and positioned on the other side of the tube.

In FIGS. 4*a*, 4*b* and 4*c*, another apparatus arrangement is disclosed by which the necessity for the operator to be skillful and careful in manipulating an air doffer in making the yarn tie-up is minimized.

In reference to FIG. 4*a*, the yarn 60 is shown as being positioned in engagement in a partial arch with a surface portion of yarn package tube 62, at an initial location along the tube length that is away from and out of contact with the groove 64 and adjacent corner as formed by cross-cut notch 66. The yarn extends between a first yarn guide 68, which is located along one side of the yarn package tube, and a second yarn guide 70, which is located along the other side of the yarn package tube. Each of the first and second yarn guides is pivotally mounted about pivot points 72 and 74, respectively.

When the second yarn guide is released for movement in a sidewise direction so as to guide the yarn 60 sideways along the surface of the rotating tube, the movement of the second yarn guide is transmitted to the first yarn guide by the follower-like cam follower end portion 76, which is located at the opposite end of the second yarn guide 70 and which is in engagement with the cam 78. Cam 78 is located at the opposite end of the first yarn guide 68. The initial motion of the first yarn guide 68, therefore, may be a reverse pivoting motion (as shown by the arrows) which, along with the sidewise motion of the second yarn guide, cooperate together to guide the yarn sideways along the surface of the tube until (1) the yarn drops into the groove 64, as shown in FIG. 4(*b*), and (2) the portion of the yarn exiting from the groove bends around slightly over one of the shoulders of the groove.

Figure 3C:
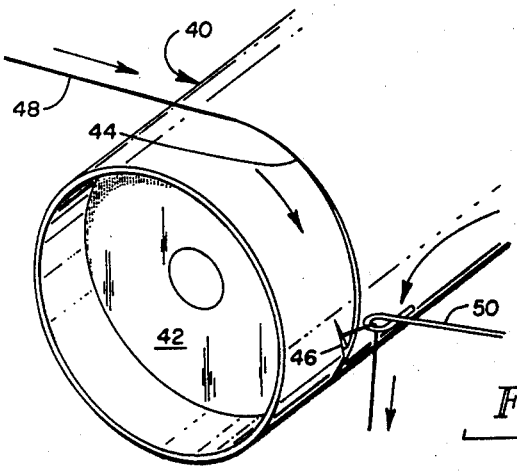
FIG. 3*c* is a view similar to FIGS. 3*a* and 3*b* but illustrating the yarn having been deflected by the acute-angled corner.

The exiting yarn portion is thereafter snagged and deflected by the acute-angled corner, in the manner shown in FIG. 3*c*.

In FIG. 4*c*, the yarn is illustrated as having been tied-up to the yarn package tube 62; a waste bunch 80 is illustrated as having been formed in and on top of the groove 64; a transfer tail 82 is illustrated as having been formed; and the yarn is further illustrated as having been released from the first yarn guide 68 for pick-up by a self-threading yarn traverse guide 84 to begin the winding of the yarn package, the beginning windings illustrated at 86.

The invention has been described in detail with particular reference to preferred embodiments thereof, but it will be understood that variations and modifications can be effected within the spirit and scope of the invention.

I claim:

1. In a textile yarn package tube particularly adapted for use in high speed rotary winding operations of yarn, said tube comprising a substantially cylindrical body having formed in its external surface adjacent one end thereof a groove defined by a pair of side walls extending into the surface of said body and extending at least partly around said body in a plane substantially perpendicular to the rotation axis of the tube, the improvement comprising: a corner formed in one of the groove side walls intersecting at an angle with said one side wall of the groove and pointing generally in the direction of intended rotation of the tube and adapted in rotary winding of yarn operations, as a yarn enters the groove in one direction of movement, for snagging yarn exiting from the groove and deflecting said yarn around said corner for changing the direction of movement of the exiting yarn to thereby trap and sever the yarn for winding.

2. In a textile yarn package tube as defined in claim 1, wherein the corner is located between the groove and said one end of said cylindrical body.

3. In a textile yarn package tube as defined in claim 1, wherein said corner includes a side wall intersecting said one side wall of said groove in an acute angle of about 25° to about 60°.

4. In a textile yarn package tube as defined in claim 1, wherein said corner is bounded on one side by a cross-cut notch that is defined by a pair of side walls converging to an acute angle away from said one side wall of said groove.

5. In a textile yarn package tube as defined in claim 1, wherein said corner is displaced from said one side wall of the groove in a direction toward the opposite side wall of said groove and extends in part over the groove.

6. In a textile yarn package tube as defined in claim 1, wherein said pair of side walls of the groove meet in an acute angle at the bottom of the groove.

7. In a textile yarn package tube as defined in claim 1, wherein said corner includes a side wall intersecting said one side wall of said groove in an acute angle of about 30° to about 45°.

8. In a textile yarn package tube as defined in claim 1, wherein said corner includes a side wall intersecting said one side wall of said groove in an acute angle of about 35°.

9. In a textile yarn package tube as defined in claim 1, wherein the corner is raised slightly above the surface of said cylindrical body.

10. In a textile yarn package tube as defined in claim 1, wherein said pair of side walls of the groove define, respectively, an outboard wall adjacent said one end of said cylindrical body and an inboard wall axially inwardly along said cylindrical body from said outboard wall, and wherein said corner is in said outboard wall of said groove.

11. In a textile yarn package tube as defined in claim 5, wherein the corner is also raised slightly above the surface of said cylindrical body.

12. Method of forming a yarn transfer tail on a yarn package tube that is supported on a rotating mandrel of a yarn winder, the yarn moving continuously from a source of supply to the yarn package tube for engagement with a portion of the surface thereof and away from the tube, as into an air doffer, the portion of said surface to be engaged rotating in the same direction as the direction of yarn movement; the supported yarn package tube comprising:

(a) a substantially cylindrical body having formed in its external surface adjacent one end thereof a groove defined by a pair of side walls extending into the surface of the cylindrical body and extending at least partly around said cylindrical body in a plane substantially perpendicular to the rotation axis of the tube, and (b) the cylindrical body also having a corner formed in one of the groove side walls intersecting at an angle with said one side wall of the groove and pointing generally in the direction of intended rotation of the tube and adapted in rotary winding operations, as a yarn enters the groove in one direction of movement, for snagging a portion of the yarn exiting from the groove and deflecting said yarn around said corner for changing the direction of movement of the exiting yarn portion as said corner rotates with said tube away from where the yarn approaches said surface portion of the tube; the method comprising:

(1) positioning the continuously moving yarn so that the yarn moves into engagement with said surface portion of the rotating supported yarn package tube in a partial arch at an initial location along the tube length that is away from and out of contact with the groove and said corner;

(2) guiding the yarn sideways along the surface of the rotating yarn package tube toward the groove and said corner until the yarn drops into the groove and the exiting portion of the yarn engages said corner and becomes snagged and deflected therearound for changing the direction of movement of the exiting portion as the corner rotates with the tube away from where the yarn approaches said surface portion of the tube, and thereby tying-up the yarn to the tube and subsequently snapping and severing the yarn from the yarn going away from the tube;

(3) winding the continuously moving yarn, as tied-up to the rotating supported tube, into a number of wraps to form a waste bunch;

(4) winding the continuously moving yarn into a number of spaced apart helical wraps to form a transfer tail adjacent the waste bunch; and (5) thereafter winding the continuously moving yarn into a yarn package adjacent the transfer tail.

13. In the method as defined in claim 12, wherein said corner is located between the groove and said one end of said cylindrical body.

14. In the method as defined in claim 12, wherein said corner includes a side wall intersecting said one side wall of said groove in an acute angle of about 25° to about 60°.

15. In the method as defined in claim 12, wherein said corner includes a side wall intersecting one side wall of said groove in an acute angle of about 30° to about 45°.

16. In the method as defined in claim 12, wherein said corner includes a side wall intersecting said one side wall of said groove in an acute angle of about 35°.

17. In the method as defined in claim 12, wherein said corner is displaced from said one side wall of the groove in a direction toward the opposite side wall of said groove and extends in part over the groove.

18. In the method as defined in claim 12, wherein said pair of side walls of the groove meet in an acute angle at the bottom of the groove, and said yarn becomes trapped in the bottom of the groove upon the yarn being snapped and severed from the yarn going away from the tube.

19. In the method as defined in claim 12, wherein the corner is raised slightly above the surface of said cylindrical body.

20. In the method as defined in claim 17, wherein the corner is also raised slightly above the surface of said cylindrical body.

21. In the method as defined in claim 12, wherein said pair of side walls of the groove define, respectively, an outboard wall adjacent said one end of said cylindrical body and an inboard wall axially inwardly along said cylindrical body from said outboard wall, and wherein said corner is in said outboard wall of said groove.

22. Apparatus for forming a yarn transfer tail on a yarn package tube that is supported on a rotating mandrel of a yarn winder, the yarn moving continuously from a source of supply to the yarn package tube for engagement with a portion of the surface thereof and away from the yarn package tube, the portion of said surface to be engaged rotating in the same direction as the direction of yarn movement, the yarn winder having a self-threading yarn traverse guide reciprocating along a path parallelly spaced from the package portion of the yarn package tube, the supported yarn package tube comprising:

a. a substantially cylindrical body having formed in its external surface adjacent one end thereof a groove defined by a pair of side walls extending into the surface of the cylindrical body and extending at least partly around said cylindrical body in a plane substantially perpendicular to the rotation axis of the tube, and (b) the cylindrical body also having a corner formed in one of the groove side walls intersecting at an angle with said one side wall of the groove and pointing generally in the direction of intended rotation of the tube and adapted in rotary winding operations, as a yarn enters the groove in one direction of movement, for snagging a portion of the yarn exiting from the groove and deflecting said yarn around said corner for changing the direction of movement of the exiting yarn portion as said corner rotates with said tube away from where the yarn approaches said surface portion of the tube; the apparatus comprising:

means for positioning the continuously moving yarn in engagement with said surface portion of the yarn package tube in a partial arch at an initial location that is away from and out of contact with the groove and said corner; said positioning means including means for guiding the yarn sideways along the surface of the rotating yarn package tube toward the groove and said corner until the yarn drops into the groove and the exiting portion of the yarn engages said corner and becomes snagged and deflected therearound, thereby changing the direction of movement of the exiting yarn portion as said corner rotates with the tube away from where the yarn approaches said surface portion of the tube, and consequently tying-up the yarn to the tube, and subsequently snapping and severing the yarn from the yarn moving away from the tube; and said positioning means also including means guiding the continuously moving yarn, as consequently tied-up to the rotating supported tube, to form a waste bunch of a predetermined number of wraps and a transfer tail of a predetermined number of spaced helical wraps adjacent to the waste bunch, with subsequent release of the guided yarn to be picked-up by said yarn traverse guide for guiding the yarn as the yarn package is wound.

23. Apparatus as defined in claim 22, wherein the corner is located between the groove and said one end of said cylindrical body.

24. Apparatus as defined in claim 22, wherein said corner includes a side wall intersecting said one side wall of said groove in an acute angle of about 25° to about 60°.

25. Apparatus as defined in claim 22, wherein said corner is displaced from said one side wall of the groove in a direction toward the opposite side wall of said groove and extends in part over the groove.

26. Apparatus as defined in claim 22, wherein said pair of side walls of the groove meet in an acute angle at the bottom of the groove.

27. Apparatus as defined in claim 22, wherein said corner includes a side wall intersecting said one side wall of said groove in an acute angle of about 30° to about 45°.

28. Apparatus as defined in claim 22, wherein said corner includes a side wall intersecting said one side wall of said groove in an acute angle of about 35°.

29. Apparatus as defined in claim 22, wherein the corner is raised slightly above the surface of said cylindrical body.

30. Apparatus as defined in claim 22, wherein said pair of side walls of the groove define, respectively, an outboard wall adjacent said one end of said cylindrical body and an inboard wall axially inwardly along said cylindrical body from said inboard wall, and wherein said corner is in said outboard wall of said groove.

31. Apparatus as defined in claim 25, wherein the corner is also raised slightly above the surface of said cylindrical body.

* * * * *